US010898822B1

(12) United States Patent
Dejong

(10) Patent No.: US 10,898,822 B1
(45) Date of Patent: Jan. 26, 2021

(54) DUAL FLYING DISK DEVICE

(71) Applicant: Thomas Dejong, Flanders, NJ (US)

(72) Inventor: Thomas Dejong, Flanders, NJ (US)

( * ) Notice: Subject to any disclaimer, the term of this patent is extended or adjusted under 35 U.S.C. 154(b) by 0 days.

(21) Appl. No.: 16/437,019

(22) Filed: Jun. 11, 2019

(51) Int. Cl.
*A63H 33/18* (2006.01)

(52) U.S. Cl.
CPC ..... *A63H 33/18* (2013.01)

(58) Field of Classification Search
CPC ..... A63H 33/18
USPC ..... 446/46; 273/317
See application file for complete search history.

(56) References Cited

U.S. PATENT DOCUMENTS 3,855,728 A 12/1974 Hynds
4,212,131 A * 7/1980 Ross, Jr. ..... A63H 33/18 446/46
5,263,819 A 11/1993 O'Leary
5,480,334 A 1/1996 Wilson
5,674,102 A * 10/1997 Lin ..... A63H 33/18 446/46
D414,823 S 10/1999 Gardner
6,422,959 B1 7/2002 Hsu
7,217,169 B1 * 5/2007 Anderson ..... A63H 33/18 446/46
9,345,984 B2 * 5/2016 White ..... A63H 33/18
2008/0287031 A1 11/2008 Brooks

FOREIGN PATENT DOCUMENTS

DE 20019367 1/2001

* cited by examiner

*Primary Examiner* — Vishu K Mendiratta

(57) ABSTRACT

The dual flying disk device comprises a primary disk, a disk receiver, a secondary disk, and one or more auxiliary disks. The primary disk, the secondary disk, and the one or more auxiliary disks may be detachably coupled to each other and thrown as a single throwing unit. The secondary disk may separate from the primary disk and travel on its own trajectory after being thrown. The one or more auxiliary disks may separate from the secondary disk and travel on their own trajectory after being thrown. A disk receiver may be coupled to the primary disk via two or more support struts. The secondary disk may detachably couple to the primary disk via the disk receiver. A plurality of loops disposed around the edge of the primary disk may aid in throwing or catching the primary disk.

16 Claims, 3 Drawing Sheets

DUAL FLYING DISK DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of toys and games, more specifically, a dual flying disk device.

SUMMARY OF INVENTION

The dual flying disk device comprises a primary disk, a disk receiver, a secondary disk, and one or more auxiliary disks. The primary disk, the secondary disk, and the one or more auxiliary disks may be detachably coupled to each other and thrown as a single throwing unit. The secondary disk may separate from the primary disk and travel on its own trajectory after being thrown. The one or more auxiliary disks may separate from the secondary disk and travel on their own trajectory after being thrown. A disk receiver may be coupled to the primary disk via two or more support struts. The secondary disk may detachably couple to the primary disk via the disk receiver. A plurality of loops disposed around the edge of the primary disk may aid in throwing or catching the primary disk.

An object of the invention is to provide a throwable toy comprising multiple flying disks.

Another object of the invention is to provide a disk receiver coupled to the primary disk via two or more support structs.

A further object of the invention is to provide a secondary disk that may detachably couple to the disk receiver such that the secondary disk may be released during the flight of the primary disk.

Yet another object of the invention is to provide one ore more auxiliary disks that may detachably couple to the secondary disk such that the auxiliary disks may be released during the flight of the secondary disk.

These together with additional objects, features and advantages of the dual flying disk device will be readily apparent to those of ordinary skill in the art upon reading the following detailed description of the presently preferred, but nonetheless illustrative, embodiments when taken in conjunction with the accompanying drawings.

In this respect, before explaining the current embodiments of the dual flying disk device in detail, it is to be understood that the dual flying disk device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the dual flying disk device.

It is therefore important that the claims be regarded as including such equivalent construction insofar as they do not depart from the spirit and scope of the dual flying disk device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the work "or" is intended to be inclusive.

Figure 1:
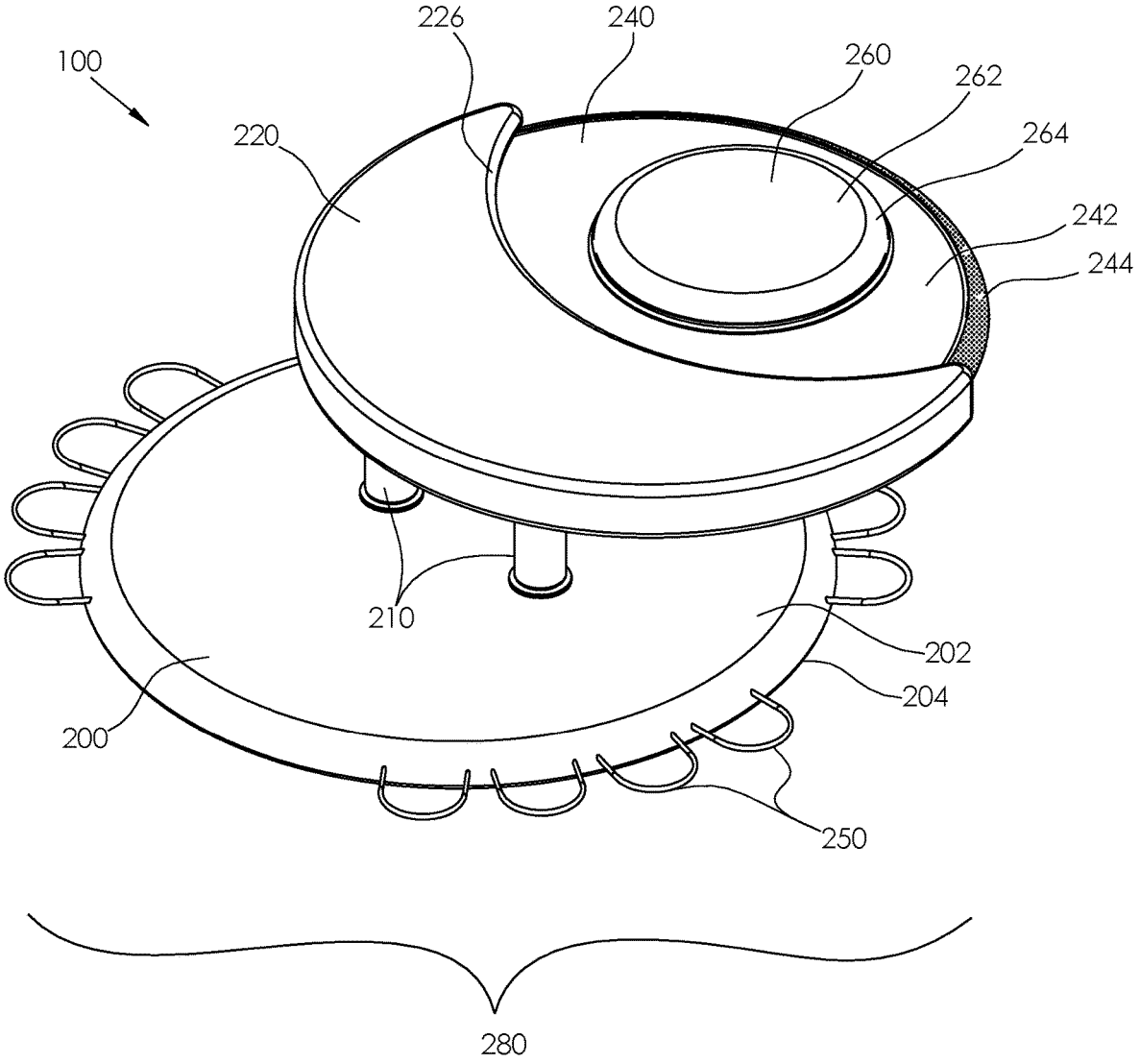
FIG. 1 is a perspective view of an embodiment of the disclosure.
Figure 2:
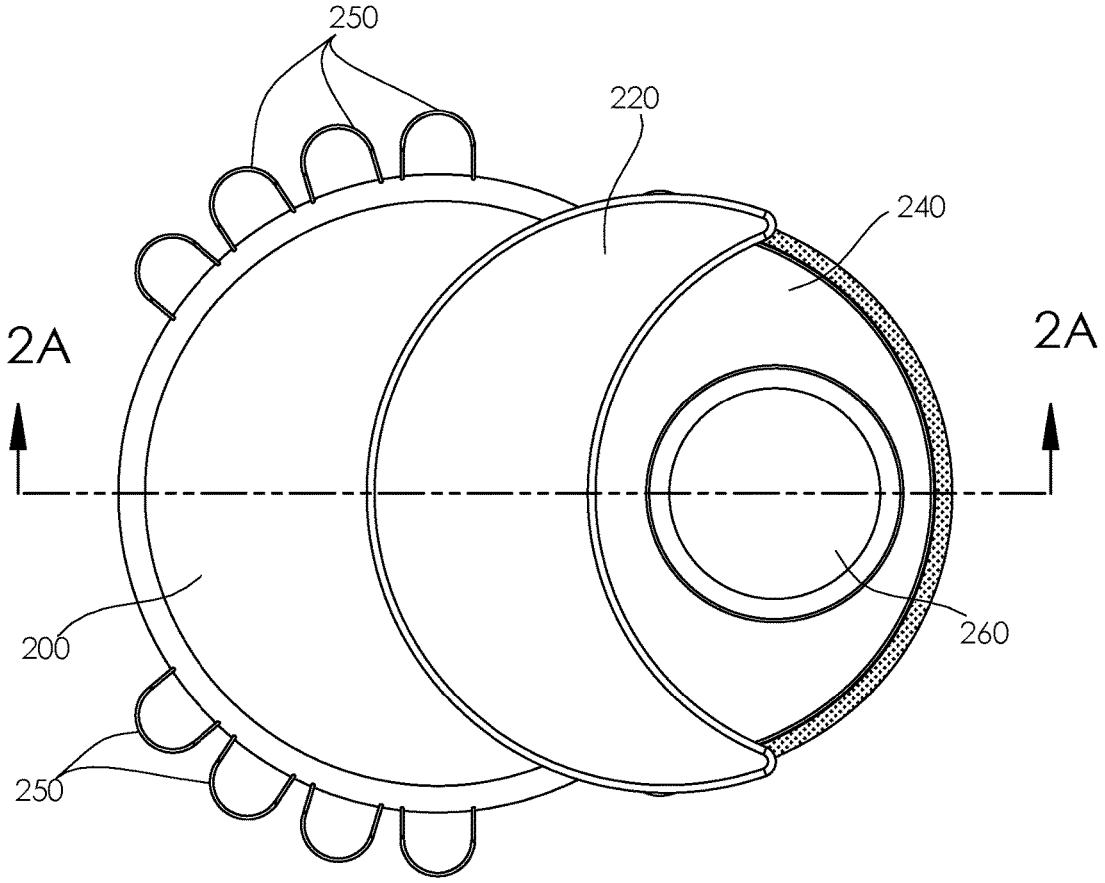
FIG. 2 is a top view of an embodiment of the disclosure.
Figure 2B:
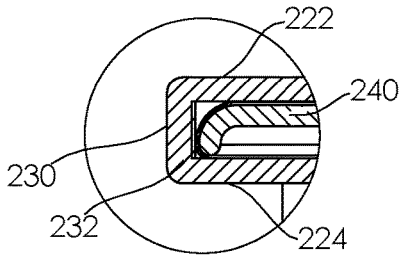
FIG. 2B is a detail view of an embodiment of the disclosure illustrating the area marked 2B in FIG. 2A.
Figure 2A:
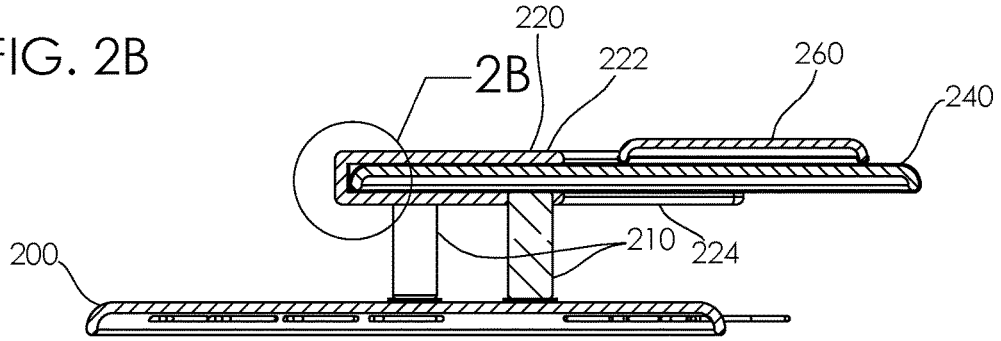
FIG. 2A is a cross-sectional view of an embodiment of the disclosure across 2A-2A as shown in FIG. 2.
Figure 3:
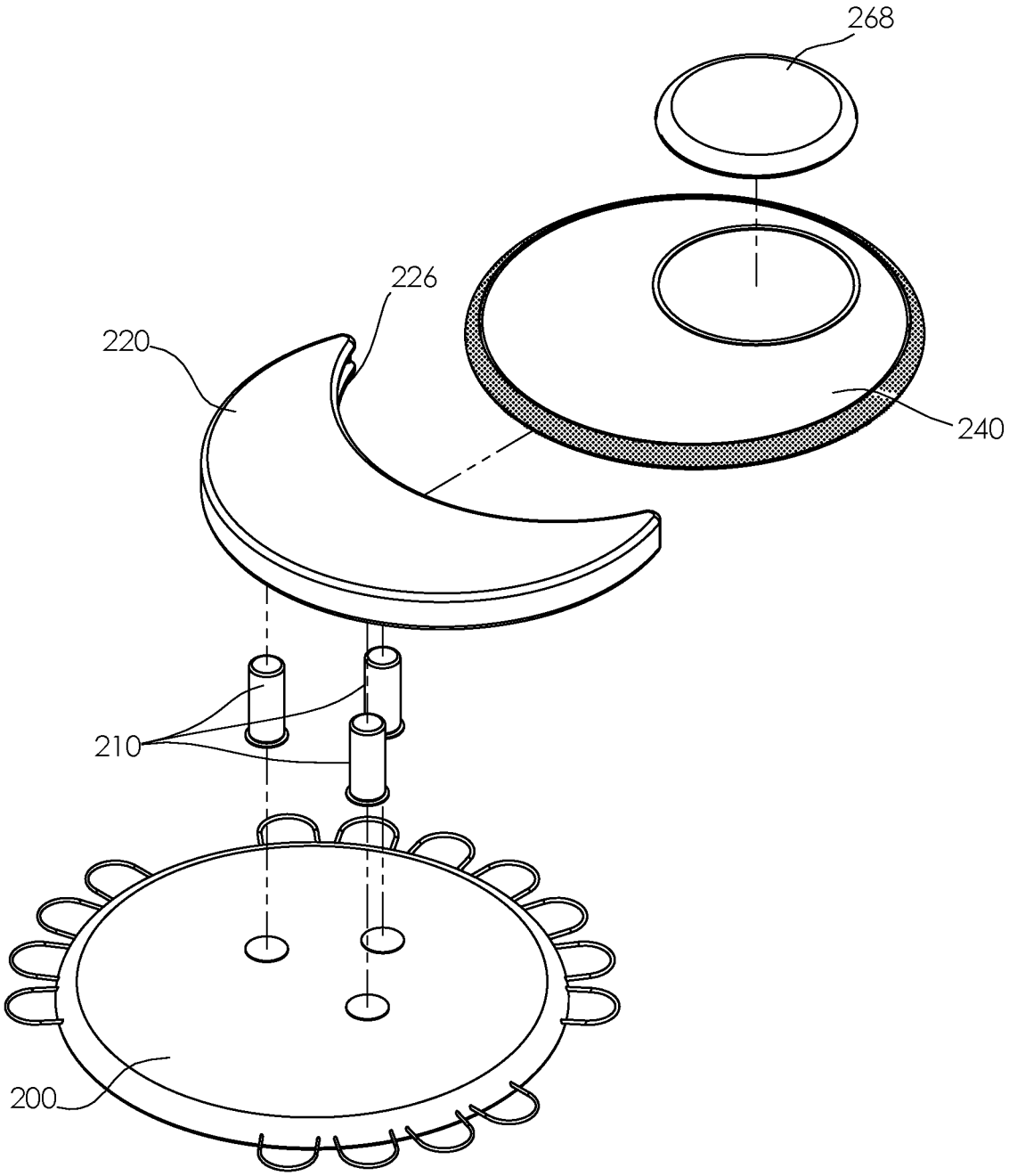
FIG. 3 is an exploded view of an embodiment of the disclosure.

Detailed reference will now be made to a first potential embodiment of the disclosure, which is illustrated in FIGS. 1 through 3.

The dual flying disk device 100 (hereinafter invention) comprises a primary disk 200, a disk receiver 220, a secondary disk 240, and one or more auxiliary disks 260. The primary disk 200, the secondary disk 240, and the one or more auxiliary disks 260 may be detachably coupled to each other and thrown as a single throwing unit 280. The secondary disk 240 may separate from the primary disk 200 and travel on its own trajectory after being thrown. The one or more auxiliary disks 260 may separate from the secondary disk 240 and travel on their own trajectory after being thrown.

The primary disk 200 may be a circular flying disk toy comprising a primary top surface 202 and a primary edge 204. The primary disk 200 made be made of a rigid or semi-rigid material. The primary top surface 202 and the primary edge 204 may give the primary disk 200 a convex shape as seen from above, with the primary top surface 202 being higher than the bottom end of the primary edge 204. Circular flying disk toys may fly for some distance when thrown with a spin. The spin may make the circular flying disk toy stable due to gyroscopic force. The convex shape of the circular flying disk toy may provide lift to keep it airborne.

The disk receiver 220 may be a holder for the secondary disk 240. The disk receiver 220 may comprise a receiver top surface 222 and a receiver bottom surface 224 which parallel each other and which have a crescent shaped when viewed from above or from below. The disk receiver 220 may comprise a receiver outer edge 230 which couples the receiver top surface 222 to the receiver bottom surface 224. The disk receiver 220 may comprise a receiver inner wall 232 which couples the receiver top surface 222 to the receiver bottom surface 224. The disk receiver 220 may comprise a receiver aperture 226 which may be an opening into which the secondary disk 240 may be inserted.

The disk receiver 220 may be coupled to the primary disk 200 via two or more support struts 210. Each of the two or more support struts 210 may couple to the primary top surface 202 of the primary disk 200 and to the receiver bottom surface 224. In some embodiments, the two or more support struts 210 may be detachable from the primary disk 200, from the disk receiver 220, or from both. The two or more support struts 210 that are detachable may couple to the primary disk 200 or to the disk receiver 220 using hook and loop fasteners, interference fit, or other detachable couplers.

The secondary disk 240 may be a circular flying disk toy comprising a secondary top surface 242 and a secondary edge 244. The secondary disk 240 made be made of a rigid or semi-rigid material. The secondary top surface 242 and the secondary edge 244 may give the secondary disk 240 a convex shape as seen from above, with the secondary top surface 242 being higher than the bottom end of the secondary edge 244. The disk receiver 220 may be oriented to hold the secondary disk 240 parallel to the primary disk 200 while the secondary disk 240 is within the disk receiver 220. The secondary disk 240 may couple to the disk receiver 220 using hook and loop fasteners, interference fit, or other detachable couplers.

The one or more auxiliary disks 260 may be coupled to the secondary top surface 242 of the secondary disk 240. Each of individual auxiliary disks 268 selected from the one or more auxiliary disks 260 may be smaller in diameter than the secondary disk 240. The individual auxiliary disk 268 may be a circular flying disk toy comprising an auxiliary top surface 262 and an auxiliary edge 264. The individual auxiliary disk 268 made be made of a rigid or semi-rigid material. The auxiliary top surface 262 and the auxiliary edge 264 may give the individual auxiliary disk 268 a convex shape as seen from above, with the auxiliary top surface 262 being higher than the bottom end of the auxiliary edge 264. As non-limiting examples, each of the one or more auxiliary disks 260 may couple to the secondary disk 240 using hook and loop fasteners, interference fit, or other detachable couplers.

The invention 100 may comprise a plurality of loops 250 that are coupled to the primary edge 204 of the primary disk 200. The plurality of loops 250 may aid in the throwing or catching of the primary disk 200. Each of the plurality of loops 250 may be a semi-circular hoop that is oriented to lie in the plane of the primary disk 200. The plurality of loops 250 may be made of a semi-rigid material.

In use, the disk receiver 220 is coupled to the primary disk 200 via the two or more support struts 210, the one or more auxiliary disks 260 are coupled to the secondary disk 240, and the secondary disk 240 is coupled to the disk receiver 220. The single throwing unit 280 thus formed may be thrown by holding the primary disk 200 horizontally near the user's body, thrusting the throwing arm forward, and releasing the primary disk 200 with a snapping action of the user's wrist. When thrown in this manner, the single throwing unit 280 may spin rapidly as it leaves the hand of the user. Centrifugal force may cause the secondary disk 240 to separate from the disk receiver 220 as the single throwing unit 280 travels forward such that the primary disk 200 and the secondary disk 240 spin and travel in different directions. Rotation of the secondary disk 240 may cause the one or more auxiliary disks 260 to separate and travel in their own directions. Multiple games may be played with goals related to catching the plurality of flying disks, avoiding the flying disks, aiming the flying disks at one or more targets, or other criteria.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, an "aperture" is an opening in a surface. Aperture may be synonymous with hole, slit, crack, gap, slot, or opening.

As used in this disclosure, "convex" is used to describe a surface that resembles the exterior surface of a sphere or a portion thereof.

As used herein, the words "couple", "couples", "coupled" or "coupling", refer to connecting, either directly or indirectly, and does not necessarily imply a mechanical connection.

As used in this disclosure, a "crescent" is a two edged geometric shape formed from the overlapping of a first circle by a second circle. The diameter of the first circle and the diameter of the second circle may or may not be identical. The first circle and the second circle may or may not share a common center point. The crescent is formed by: 1) overlaying the second circle on the first circle such that two points of intersection are formed; 2) using the second circle as a negative space that removes the area and segment of the circumference of the first circle that is contained within the second circle, and 3) replacing the removed circumference of the first circle with the segment of the circumference of the second circle contained within the area of the first circle to form the second edge of the crescent. Within the scope of this definition an ellipse may be substituted for either (or both) of the first circle and the second circle. Further, within the scope of this definition either (or both) of the two intersection points may be rounded, as defined elsewhere in this disclosure, for decorative purposes.

As used in this disclosure, a "diameter" of an object is a straight line segment that passes through the center (or center axis) of an object. The line segment of the diameter is terminated at the perimeter or boundary of the object through which the line segment of the diameter runs.

As used herein, the term "friction fit" refers to a type of mechanical coupling where a first component presses into a second component and is held there only by the friction of the first component against the second component. A friction fit may also be known as an interference fit or a press fit.

As used in this disclosure, a "hook and loop fastener" is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface.

As used in this disclosure, "horizontal" is a directional term that refers to a direction that is perpendicular to the local force of gravity. Unless specifically noted in this disclosure, the horizontal direction is always perpendicular to the vertical direction.

As used in this disclosure, "resilient" or "semi-rigid" refer to an object or material which will deform when a force is applied to it and which will return to its original shape when the deforming force is removed.

As used herein, "rigid" refers to an object or material which is inflexible. If a force is applied to a rigid object the rigid object does not bend or deform unless the force applied reaches the breaking point of the rigid object.

With respect to the above description, it is to be realized that the optimum dimensional relationship for the various components of the invention described above and in FIGS. 1 through 3, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A dual flying disk device comprising:

a primary disk, a disk receiver, a secondary disk, and one or more auxiliary disks;

wherein the primary disk, the secondary disk, and the one or more auxiliary disks are detachably coupled to each other, either directly or indirectly, and are thrown as a single throwing unit;

wherein the secondary disk separates from the primary disk and travels on its own trajectory after being thrown;

wherein the one or more auxiliary disks separate from the secondary disk and travel on their own trajectory after being thrown;

wherein the primary disk is a circular flying disk toy comprising a primary top surface and a primary edge;

wherein the primary top surface and the primary edge give the primary disk a convex shape as seen from above, with the primary top surface being higher than the bottom end of the primary edge;

wherein the disk receiver is a holder for the secondary disk;

wherein the disk receiver comprises a receiver top surface and a receiver bottom surface which parallel each other and which have a crescent shaped when viewed from above or from below;

wherein the disk receiver comprises a receiver outer edge which couples the receiver top surface to the receiver bottom surface;

wherein the disk receiver comprises a receiver inner wall which couples the receiver top surface to the receiver bottom surface;

wherein the disk receiver comprises a receiver aperture which is an opening into which the secondary disk is inserted.

2. The dual flying disk device according to claim 1 wherein the primary disk is made of a rigid or semi-rigid material.

3. The dual flying disk device according to claim 2 wherein the disk receiver is coupled to the primary disk via two or more support struts;

wherein each of the two or more support struts couples to the primary top surface of the primary disk and to the receiver bottom surface.

4. The dual flying disk device according to claim 3 wherein the two or more support struts are detachable from the primary disk, from the disk receiver, or from both.

5. The dual flying disk device according to claim 4 wherein the two or more support struts couple to the primary disk or to the disk receiver using hook and loop fasteners, interference fit, or other detachable couplers.

6. The dual flying disk device according to claim 5 wherein the secondary disk is a circular flying disk toy comprising a secondary top surface and a secondary edge;

wherein the secondary disk made be made of a rigid or semi-rigid material.

7. The dual flying disk device according to claim 6 wherein the secondary top surface and the secondary edge give the secondary disk a convex shape as seen from above, with the secondary top surface being higher than the bottom end of the secondary edge;

wherein the disk receiver is oriented to hold the secondary disk parallel to the primary disk while the secondary disk is within the disk receiver.

8. The dual flying disk device according to claim 7 wherein the secondary disk couples to the disk receiver using hook and loop fasteners, interference fit, or other detachable couplers.

9. The dual flying disk device according to claim 8 wherein the one or more auxiliary disks are coupled to the secondary top surface of the secondary disk.

10. The dual flying disk device according to claim 9 wherein each of individual auxiliary disks selected from the one or more auxiliary disks are smaller in diameter than the secondary disk.

11. The dual flying disk device according to claim 10 wherein the individual auxiliary disk is a circular flying disk toy comprising an auxiliary top surface and an auxiliary edge;

wherein the individual auxiliary disk made be made of a rigid or semi-rigid material.

12. The dual flying disk device according to claim 11 wherein the auxiliary top surface and the auxiliary edge give the individual auxiliary disk a convex shape as seen from above, with the auxiliary top surface being higher than the bottom end of the auxiliary edge.

13. The dual flying disk device according to claim 12 wherein each of the one or more auxiliary disks couple to the secondary disk using hook and loop fasteners, interference fit, or other detachable couplers.

14. The dual flying disk device according to claim 13 further comprising:

a plurality of loops that are coupled to the primary edge of the primary disk;

wherein the plurality of loops aid in the throwing or catching of the primary disk.

15. The dual flying disk device according to claim 14 wherein each of the plurality of loops are a semi-circular hoop that are oriented to lie in the plane of the primary disk.

16. The dual flying disk device according to claim 15 wherein the plurality of loops are made of a semi-rigid material.

* * * * *